United States Patent [19]

Seaborn

[11] 3,937,171

[45] Feb. 10, 1976

[54] MULTIHULL TUGBOAT

[76] Inventor: John K. Seaborn, 6638 Colton Blvd., Alameda, Calif. 94501

[22] Filed: July 12, 1974

[21] Appl. No.: 488,193

[52] U.S. Cl. ..... 114/235 R; 114/61

[51] Int. Cl.[2] ..... B63B 21/56

[58] Field of Search..... 114/61, 235 R, 235 A, 219, 114/236; 9/2 F, 2 R; 180/79.2 B

[56] References Cited

UNITED STATES PATENTS

| | | | |
|---|---|---|---|
| 2,106,432 | 1/1938 | McIntyre | 114/61 |
| 3,398,716 | 8/1968 | Neilson | 114/235 R |
| 3,494,318 | 2/1970 | Katsumura | 114/235 R |

FOREIGN PATENTS OR APPLICATIONS

| | | | |
|---|---|---|---|
| 636,643 | 2/1962 | Canada | 114/219 |

*Primary Examiner*—Trygve M. Blix
*Assistant Examiner*—Charles E. Frankfort
*Attorney, Agent, or Firm*—Owen, Wickersham & Erickson

[57] ABSTRACT

A tugboat of the kind used for moving and steering barges has laterally spaced individual hulls which are connected together by cross members in a parallel linkage connection. This permits the hulls to move relative to one another longitudinally while the hulls are retained parallel and laterally spaced apart.

13 Claims, 5 Drawing Figures

MULTIHULL TUGBOAT

BACKGROUND OF THE INVENTION

This invention relates to a tugboat and particularly to a tugboat having two or more laterally spaced apart individual hulls.

Tugboats must be capable of producing large thrusts and must be highly maneuverable. Efficiency and a high degree of stability are desirable attributes. The ability to operate tugboats with the minimum of personnel is also an important economic consideration.

SUMMARY OF THE INVENTION

The tugboat of the present invention comprises two or more narrow width individual hulls which are laterally spaced apart by cross members. The cross members are connected to the individual hulls in a way that permits the individual hulls to be shifted relative to one another in a longitudinal direction but always maintained parallel.

The lateral spacing of the individual hulls permits quite narrow width hulls to be used while high stability is retained because of the catamaran effect of the lateral spacing and the type of structural connection between the hulls.

Because the individual hulls are quite narrow in width, the hulls are efficient. The pushing and pulling power of the motor associated with each hull is therefore greater than that of a conventional single hull tugboat.

The hulls are constructed to run substantially submerged, and this also increases the efficiency because surface winds and waves have a minimum effect on the submerged hulls.

The ability to offset the individual hulls relative to one another in a longitudinal direction while maintaining the hulls parallel to one another permits the forward end of the tugboat to be canted at substantially angles with respect to an associated end of a barge or other object to be towed or pushed. This provides a high degree of maneuverability.

Each hull has its own propeller and engine, and increased power can be obtained by adding more hulls.

Because the individual hulls are always maintained parallel to one another, the tugboat can also be operated effectively with a single engine. That is, since all engines act along the same line of movement because of the parallel disposition of the hulls, the loss of an engine in one hull does not make the tugboat inoperative.

The construction and layout of the tugboat is such that it can readily be operated by only one person.

The multihull tugboat of the present invention can also be readily disassembled, transported and reassembled so that the tugboat can be operated in waters which would otherwise be inaccessible.

A multihull tugboat apparatus and method having the structural features noted above and effective to function in the ways described above constitute further, specific objects of the present invention.

Other objects, advantages and features of my invention will become apparent from the following detailed description of one preferred embodiment taken with the accompanying drawings.

DESCRIPTION OF THE PREFERRED EMBODIMENTS

Figure 1:
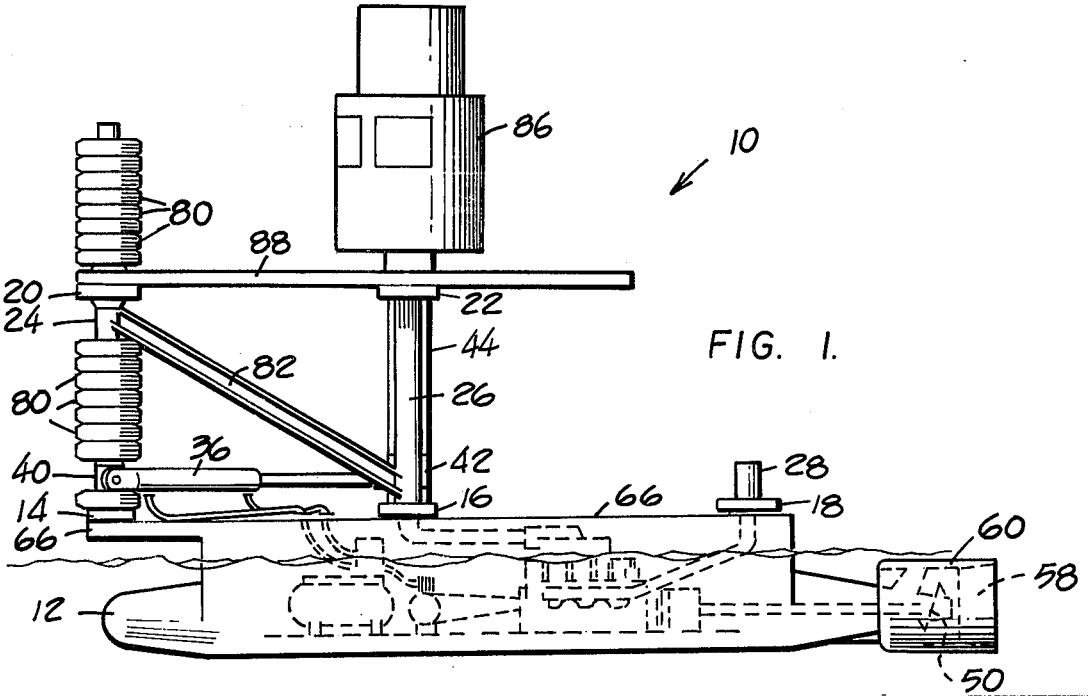
FIG. 1 is a side elevation view of a multihull tugboat constructed in accordance with one embodiment of the present invention.

A multihull tugboat constructed in accordance with one embodiment of the present invention is indicated generally by the reference numeral 10 in FIGS. 1, 3, 4 and 5.

The specific multihull tugboat 10 illustrated in the drawings has two individual hulls 12 and 13, but (as will be more apparent from the description to follow) the present invention is equally applicable to tugboats having more than two hulls. For example, a third hull and engine may be used to provide additional power.

The hulls 12 and 13 are maintained laterally spaced from one another by lower cross members 14, 16 and 18 and upper cross members 20 and 22 extending between vertical posts 24, 26 and 28 on hull 12 and vertical posts 30, 32 and 34 on hull 13.

Each end of each cross member is connected to a related post in a pin joint of connection which permits the hulls to move relative to one another in a longitudinal direction but which maintains the hulls parallel to one another at all times. The cross members thus provides a pantograph type of parallel linkage as best illustrated in the schematic plan views of FIGS. 3 and 4. As will be described in greater detail below, this parallel linkage connection not only permits narrow hulls to be laterally spaced for stability but also permits the hulls to be longitudinally offset to work with an end of a barge or other floating object for a high degree of maneuverability in steering.

Figure 3:
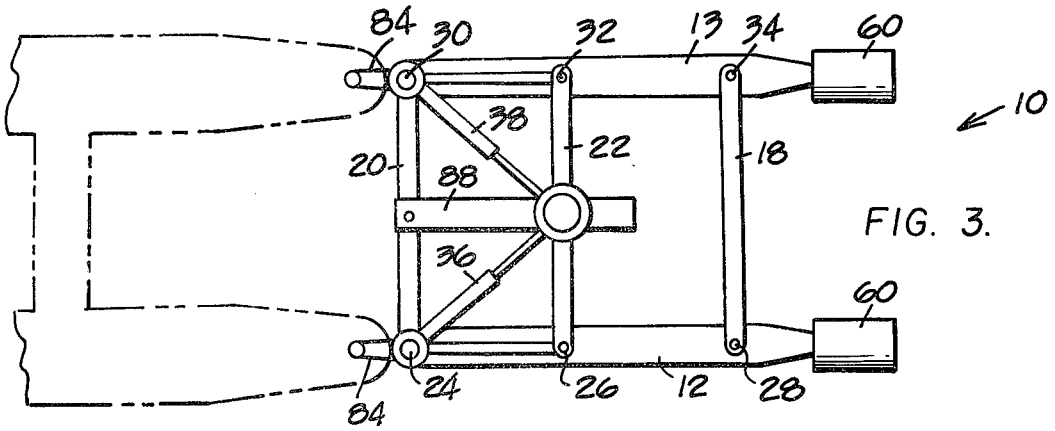
FIG. 3 is a top plan view, in schematic outline, showing the tugboat of FIG. 1 at the stern of a barge and with the individual hulls positioned for straight ahead pushing or pulling of the barge.
Figure 4:
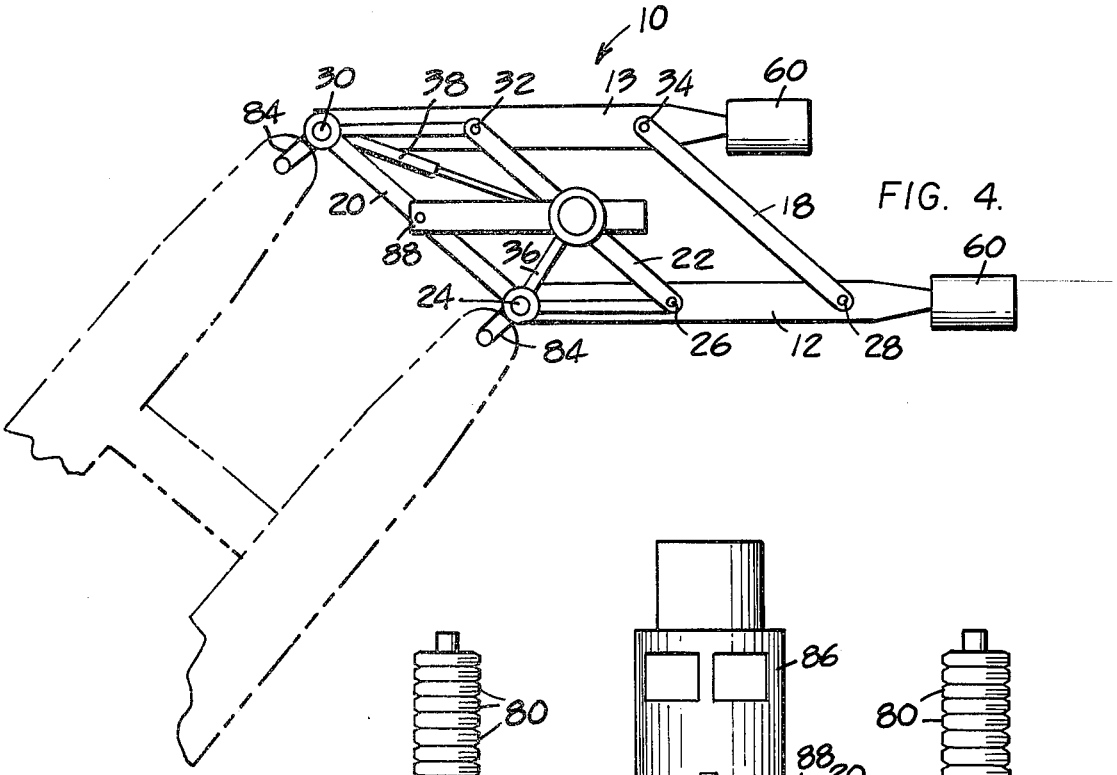
FIG. 4 is a top plan view like FIG. 3 but showing the hulls offset longitudinally for turning the barge.

The tugboat 10 has two double acting hydraulic rams 36 and 38 for changing the relative longitudinal positions of the hulls 12 and 13 such as between the aligned, straight ahead position illustrated in FIG. 3 and the offset, turning position illustrated in FIG. 4.

The forward end of the ram 36 is connected to a collar 40 which is rotatable about a lower part of the front post 24, and the other end of the hydraulic ram 36 is connected to a collar 42 which is rotatable about a lower end of a center post 44.

Similarly, the ram 38 is connected to a collar 46 on the forward post 30 and a collar 48 on the center post 44.

The upper end of the center post 44 is connected to the cross member 22 and the lower end of the center post 26 is connected to the cross member 16. This center post 44 thus provides a strong support for the forces required to shift the hulls.

Figure 2:
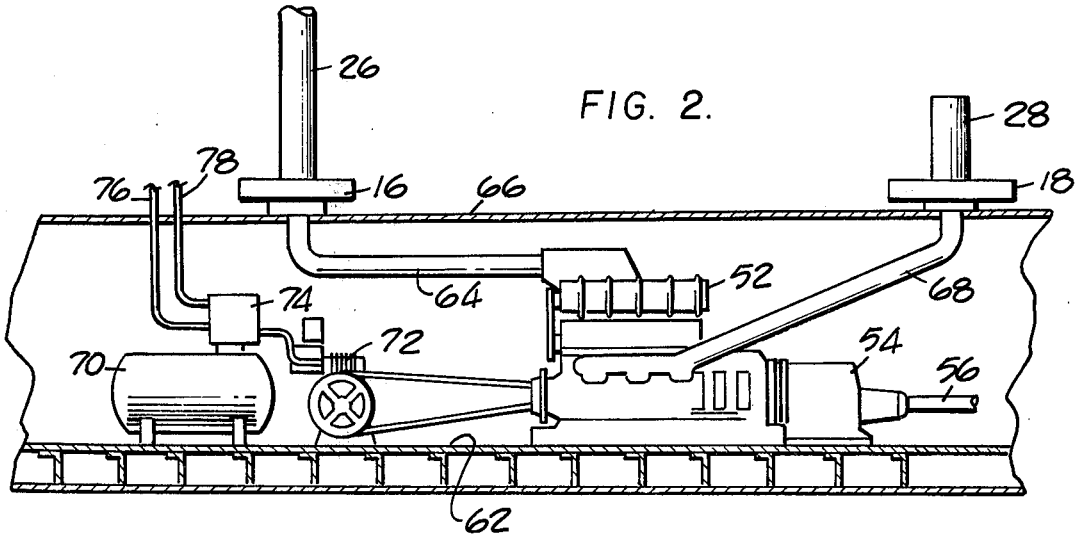
FIG. 2 is an enlarged side elevation view of a part of one hull of the tugboat shown in FIG. 1.

As best shown in FIGS. 1, 2 and 3, each hull has a propeller 50 driven by a motor 52 through a transmission 54 and a driveshaft 56.

A rudder is mounted behind each propeller 50 and is pivotal within a frame 60 extending from the back end of the hull.

The enlarged fragmentary view of FIG. 2 shows how the engine 52 and transmission 54 are mounted on a lower deck 62 within the hull.

The air inlet 64 for the engine 52 extends upward through a top deck 66 which encloses the top of the hull and is connected to the hollow interior of the forward post 26.

Similarly, the exhaust 68 for the engine 52 extends upward and into the hollow interior of the rear post 28.

The pump and drive mechanism for the hydraulic ram associated with each hull is also mounted within the hull. As best illustrated in FIG. 2, a hydraulic tank 70, a hydraulic pump 72 and the control valve arrangement 74 for the rams are all mounted on the lower interior deck 62.

The hoses 76 and 78 for the hydraulic rams extend through sealed fittings in the top deck 66.

The front posts 24 and 30 serve as fenders, and tire casings 80 are stacked on these posts to provide a resilient padding between the posts and the barge.

A brace 82 is connected between an upper part of the post 24 and the lower end of the post 26 at about the 45 degree angle as illustrated, and a similar brace, not illustrated, is connected between the posts 30 and 32.

The front surface of each fender may preferably be covered with some resilient material. The tires illustrated in FIG. 1 have been found to be quite satisfactory.

Each fender or post 24 and 30 is connected to the barge or other object to be towed or pushed by lines 84. See FIGS. 3 and 4.

Figure 5:
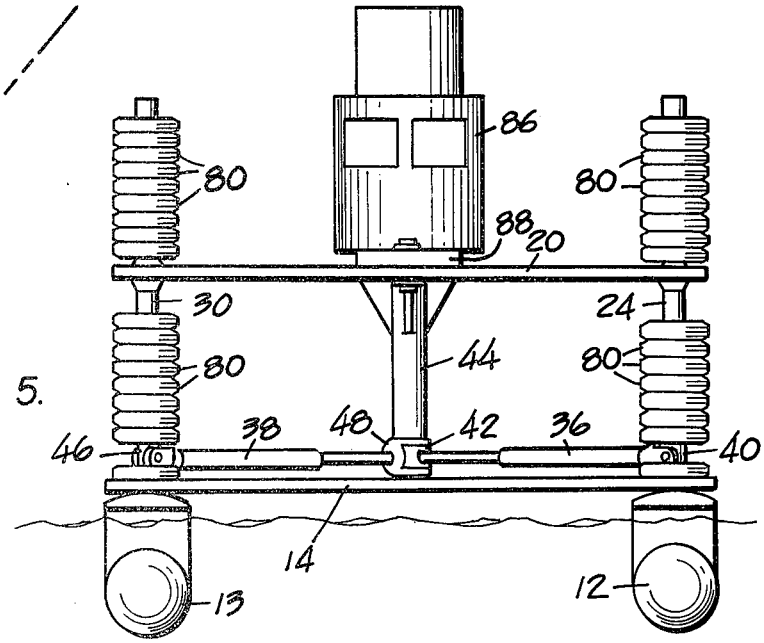
FIG. 5 is a front end elevation view of the tugboat shown in FIG. 1.

As illustrated in FIGS. 1 and 5, a control cabin 86 is mounted on the center post 44 above the cross member 22. A central member 88 connects the upper cross members 20 and 22 and the upper surfaces of members 88, 20 and 22 provide catwalks for the upper part of the tugboat. The top decks of the two hulls and the upper surface of the rear cross member 18 provide three catwalks for the lower part of the tugboat.

Each hull is a streamlined member which is constructed to be operated substantially submerged (as best illustrated in FIGS. 1 and 5) and preferably has a neutral buoyancy. Each hull is of narrow width so as to give steadier push characteristics while being affected to a minimum extent by wind and waves. The narrow width of each hull increases the speed and efficiency of the hull. And, by operating submerged, each hull minimizes the surface waves which are produced. This also increases the pushing and pulling power. There is a free flow of water to the propeller all the way around the submerged hull.

While the lower parts of the hulls are shown as generally circular in cross section in FIG. 5, this part of each hull can equally well be formed to a general hexagonal cross section to facilitate fabrication. The hulls must be rigid, and a particular tugboat construction has been made of ½ inch steel plate. However, in some instances it is preferable to fabricate the hulls from aluminum because of the lighter weight and resulting greater buoyancy.

The way in which the individual hulls are laterally spaced apart in accordance with the present invention provides a number of advantages.

Narrow width hulls have the advantages of increased efficiency and pushing and pulling power as noted above. In the present invention these narrow hulls can be used in a tugboat having a very high degree of stability because of the catamaran effect produced by the lateral spacing and interconnecting structure between the individual hulls. The laterally spaced hull arrangement provides a tugboat which is safer in operation because there is better control of the tow. A particular embodiment of the tugboat constructed in accordance with the present invention has approximately a 30 foot spacing between the propellers at the ends of the individual hulls, and this provides good steering control leverage in steering barges forward and backward.

The tugboat has a high degree of maneuverability because of the articulating pantograph movement of the hulls. The hulls will always be applied in the desired direction of movement, as best illustrated in FIG. 4.

The operating rams readily shift the twin hulls to positions in which the cross members are disposed at angles of 45° or more with respect to the hulls (see FIG. 4). The fenders at the forward end of the tugboat are thus readily offsettable to angles in the order of 45° or more. This produces a corresponding angle between the longitudinal axis of the tugboat 10 and the longitudinal axis of a towed or pushed barge.

The double acting hydraulic rams not only provide quick repositioning of the hulls but also permit the hulls to be rigidly locked in any desired relative longitudinal position.

The steerable rudders behind the propellers also add to the maneuverability obtained by longitudinal shifting of the individual hulls.

The spaced arrangement of the hulls provides increased speed. The tugboat of the present invention is at least twice as fast as a conventional tug because of the narrow semi-submarine hulls.

The multihull tugboat of the present invention has a further advantage in that the entire tugboat can be readily disassembled and shipped or transported and then reassembled at the location of use to permit the tugboat to get into what would otherwise be inaccessible waters.

Added power can be obtained by increasing the number of hulls. Thus, adding a third hull in the middle of two outer hulls increases the power by one-third because of the extra motor and propeller, and adding a fourth or fifth hull to provide a corresponding increase in power is equally feasible.

An entire hull can also be easily and quickly removed and replaced by a new hull, as may be desired when some major repair may be required for an engine or other hull component structure.

The multihull tugboat of the present invention has the further advantage of being easily operated by one person.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A multihull tugboat of the kind used for moving and steering barges and other floating objects, said tugboat comprising:

two laterally spaced individual hulls;

connecting means connecting the hulls for relative longitudinal movement while retaining the hulls parallel;

shifting means associated with said connecting means for shifting the hulls longitudinally to selectively move the prow of one hull ahead of the other hull;

propulsion means on each said hull;

an engine in each said hull for driving said propulsion means associated with that hull;

and fender means at the forward end of each hull for engagement with the barge or other object to be moved.

2. The invention defined in claim 1 wherein the hulls are narrow width for increased tugboat speed.

3. The invention defined in claim 1 wherein said shifting means include at least one hydraulic ram to position one hull with respect to the other and to lock the hulls in selected relative longitudinal positions.

4. The invention defined in claim 3 including a power unit for said hydraulic ram disposed within one of the hulls.

5. The invention defined in claim 1 wherein the connecting means comprise at least two equal length cross members connecting the individual hulls in a pantograph type connection.

6. The invention defined in claim 1 including superstructure associated with said connecting means.

7. The invention defined in claim 6 wherein the superstructure includes catwalks and a control cabin.

8. The invention defined in claim 6 wherein the tugboat is constructed to be readily disassemblable so that the tugboat can be disassembled, transported and then reassembled for use in waters which would otherwise be inaccessible.

9. The invention defined in claim 6 wherein said shifting means include a hydraulic ram for shifting the hulls longitudinally and wherein the power unit for said ram and all of the propulsion means are located within said hulls to provide a low center of gravity.

10. The invention defined in claim 6 wherein said shifting means include two hydraulic rams each connected at one end to the superstructure in a pin joint type connection and at the other end to one of the hulls in a pin joint type connection.

11. The invention defined in claim 1 wherein said fender means include a vertical post and stacked tire casings encircling the post.

12. The invention defined in claim 1 including second connecting means for connecting the tugboat to the barge or other floating object to be moved whereby the prow of the tugboat can be connected to the stern end of the barge or other object to push or pull the barge or other object while steering in the direction desired by longitudinal shifting of the hulls.

13. The invention defined in claim 1 wherein said propulsion means includes a propeller on each said hull and a rudder at one end of the hull behind the propeller.

* * * * *